United States Patent [19]

Lorenzen

[11] Patent Number: 4,759,379

[45] Date of Patent: Jul. 26, 1988

[54] METHOD AND APPARATUS FOR REGULATING THE PERMEABILITY OF CIGARETTE WRAPPERS AND THE LIKE

[75] Inventor: Heinz-Christen Lorenzen, Wentorf, Fed. Rep. of Germany

[73] Assignee: Körber AG, Hamburg, Fed. Rep. of Germany

[21] Appl. No.: 875,710

[22] Filed: Jun. 18, 1986

[30] Foreign Application Priority Data

Jun. 26, 1985 [DE] Fed. Rep. of Germany ..... 3522752

[51] Int. Cl.[4] ..... A24C 5/60

[52] U.S. Cl. ..... 131/281; 131/84.1; 131/906

[58] Field of Search ..... 131/281, 84.1, 906

[56] References Cited

U.S. PATENT DOCUMENTS 4,249,545 2/1981 Gretz et al. ..... 131/281

4,280,516 7/1981 Revland ..... 131/84.1

*Primary Examiner*—V. Millin

*Attorney, Agent, or Firm*—Peter K. Kontler

[57] ABSTRACT

A laser or a spark discharge apparatus which is used to perforate the wrapping material for rod-like fillers of tobacco and/or filter material is adjusted in dependency on variations of the characteristics of signals which denote the mass per unit length of a trimmed filler having a predetermined hardness. The wrapping material is tipping paper or cigarette paper and can be perforated prior or subsequent to draping around the trimmed filler, and the draped filler is thereupon subdivided into sections of desired length. Signals denoting the mass per unit length of the filler can be influenced by signals denoting the hardness of the filler, the filling power of the filler, the temperature of fibrous material of the filler, the moisture content of fibrous material of the filler and/or other parameters of the fibrous material and/or filler.

41 Claims, 2 Drawing Sheets

METHOD AND APPARATUS FOR REGULATING THE PERMEABILITY OF CIGARETTE WRAPPERS AND THE LIKE

BACKGROUND OF THE INVENTION

The invention relates to methods and apparatus for regulating the permeability of wrappers of plain or filter cigarettes, cigars, cigarillos, filter rod sections and like rod-shaped articles of the tobacco processing industry. More particularly, the invention relates to improvements in methods of and apparatus for regulating the permeability of wrappers of rod-shaped articles of the tobacco processing industry (hereinafter called cigarettes for short) whose fillers are formed from fibrous material the filling power of which is monitored in order to maintain the hardness of the fillers at a constant value. The fibrous material can constitute natural, reconstituted or artificial tobacco (which may but need not contain nicotine) and/or filter material.

In the manufacture of cigarettes, fibrous material (hereinafter called tobacco for the sake of convenience and simplicity) is continuously gathered into a thin layer which is converted into a narrow stream. The stream is equalized to be converted into a rod-like filler which is thereupon condensed and is simultaneously draped into cigarette paper or other suitable wrapping material in a wrapping mechanism to form a rod which is severed at desired intervals to yield a succession of cigarettes of unit length or multiple unit length. The equalizing operation normally involves removing from the stream the surplus of fibrous material in accordance with the measurement of the mass flow (quantity or mass per unit length of the filler) by a monitoring device which can include a source of corpuscular radiation (e.g., beta rays) and an ionization chamber. A cigarette making machine which operates in the just described manner is manufactured by the assignee of the present application and is known as PROTOS. The distributor unit of the PROTOS machine is described in the commonly owned U.S. Pat. No. 4,185,644 to Heitmann, and the rod forming and subdividing unit is described, for example, in commonly owned U.S. Pat. No. 4,280,516 to Reuland.

If the cigarettes are to be assembled with filter mouthpieces to form filter cigarettes, plain cigarettes issuing from the cigarette maker are fed into a tipping machine wherein they are united with filter mouthpieces by means of adhesive-coated uniting bands consisting of so-called tipping paper. The filter cigarettes are tested for the quality of their fillers, wrappers, mouthpieces and/or junctions between the tobacco-containing portions and filter mouthpieces, and the wrapper of each filter cigarette can be provided with perforations for admission of atmospheric air into the column of tobacco smoke. A filter tipping machine which can be used with the PROTOS cigarette maker is manufactured by the assignee of the present application under the name MAX 80. Reference may be had to commonly owned U.S. Pat. No. 4,281,670 to Heitmann. Commonly owned U.S. Pat. No. 4,177,670 to Heitmann discloses a method of monitoring the permeability of the wrappers of filter cigarettes, and the U.S. Pat. No. 4,281,670 further discloses the manner in which one or more lasers can be used to perforate the wrapping material. Commonly owned U.S. Pat. No. 4,247,754 to Baier discloses an apparatus for perforating wrapping material for cigarettes or the like by discharging sparks between opposite sides of the wrapping material.

It is further known to regulate the formation of a tobacco filler in such a way that the hardness (filling power) of successive increments of the filler matches or closely approximates a preselected value. Hardness is important to the smoker because her or his fingers can readily ascertain the resistance which the filler of a cigarette offers to depression. Such hardness can be monitored and regulated in lieu of monitoring and regulating the mass or quantity of fibrous material per unit length of the filler. The reason that certain manufacturers of cigarettes prefer to monitor and regulate the hardness is that the smoker is much more likely to be positively influenced by the satisfactory hardness than by the satisfactory mass or quantity per unit length of a filler which is subdivided into the fillers of cigarettes because the hardness of a cigarette is readily detectable but not the exact weight. Hardness of cigarettes can be ascertained with a suitable densimeter, e.g., with a so-called Borgwaldt densimeter. Satisfactory or standard hardness is denoted by a certain level of the movable part of the Borgwaldt densimeter.

Density of cigarette fillers or cigarette rod fillers can be ascertained directly or indirectly. Direct monitoring of the density with flowing air is disclosed in commonly owned U.S. Pat. No. 3,921,644 to von der Lohe and in British Pat. No. 1,422,992. German Offenlengungsschrift No. 22 41 774 discloses a different mode of monitoring the hardness of the filler, namely by ascertaining the force which the compacted tobacco stream applies to the wrapping mechanism during the application of a web of cigarette paper or the like. Indirect determination of filling power of a tobacco filler is disclosed in the aforementioned U.S. Pat. No. 4,280,516 to Reuland. Signals denoting the filling power can be converted into signals denoting the hardness of the filler. Reuland proposes to relate signals denoting the mass flow to signals which denote the height of the equalized stream. Another indirect determination of the hardness of a filler is disclosed in commonly owned U.S. Pat. No. 4,290,436 to Reuland who proposes to relate signals denoting the height of the equalized stream to signals which denote the height of the unequalized stream. Commonly owned U.S. Pat. No. 4,284,087 to Reuland discloses a different indirect determination of hardness according to which signals denoting the resistance which the equalized tobacco stream offers to penetration of air are processed with signals denoting the height of the equalized stream.

Commonly owned U.S. Pat. No. 4,249,545 to Gretz discloses an apparatus for perforating the wrappers of cigarettes in dependency on a characteristic of the wrapper or filler of a cigarette. However, this reference does not disclose or propose to make the perforating operation dependent upon the mass per unit length of a filler whose hardness is constant.

OBJECTS AND SUMMARY OF THE INVENTION

An object of the invention is to provide a novel and improved method of regulating the permeability of wrappers of rod-shaped articles of the tobacco processing industry in such a way that the regulating operation does not affect the taste, aroma and/or other desirable characteristics of tobacco smoke.

Another object of the invention is to provide a method which allows for a predictable regulation of the permeability of wrapping material for use in the making of cigarettes or the like while the quantity of condensate is kept at a constant value so that such quantity can be reliably reported on the packs of cigarettes and like rod-shaped smokers' articles.

A further object of the invention is to provide a novel and improved method of regulating the permeability of wrappers for rod-like fillers whose hardness is constant or at least closely approximates a selected value.

An additional object of the invention is to provide a novel and improved apparatus for the practice of the above outlined method.

Still another object of the invention is to provide a cigarette maker which embodies the improved apparatus.

A further object of the invention is to provide a filter tipping machine which embodies a portion of or an entire apparatus of the present invention.

An additional object of the invention is to provide an apparatus which can be installed in or combined with existing cigarette making, filter tipping and like machines.

Another object of the invention is to provide an apparatus which can employ many components of conventional cigarette making, filter tipping and like machines.

One feature of the invention resides in the provision of a method of regulating the permeability of wrappers of cigarettes or other rod-shaped articles of the tobacco processing industry. The method comprises the steps of forming a rod-like filler containing fibrous material (e.g., fragments of tobacco leaves) and having a predetermined hardness, draping the filler into wrapping material, generating first signals denoting the mass per unit length of the filler, perforating the wrapping material prior and/or subsequent to draping, and utilizing the first signals to adjust the perforating step. The signal generating step can include continuously and automatically monitoring the mass per unit length of a continuously moving filler.

The method can further comprise the steps of generating second signals denoting the filler power of fibrous material and utilizing the second signals (e.g., in a trimming or equalizing device for the filler) to influence the mass per unit length of the filler. Alternatively, or in addition to the just described steps, the method can comprise the steps of generating signals denoting the hardness of the filler and using such signals to influence the mass per unit length of the filler. Signals denoting the hardness and/or filling power of fibrous material can be used to equalize the filler prior to the draping step.

The method further comprises the step of subdividing the draped filler into rod-like sections of predetermined length and such method can further comprise the steps of tipping the sections of predetermined length by providing them with filter mouthpieces. The perforating step can comprise changing the permeability of the wrapping material of tipped sections. The wrapping material can include tipping paper which is used to unite sections of predetermined length with filter mouthpieces, and the perforating step can include changing the permeability of the tipping paper. The filter mouthpieces then preferably comprise foraminous outer layers.

The perforating step can include subjecting the wrapping material to the action of one or more laser beams and/or effecting a spark discharge between opposite sides of the wrapping material.

The method can further comprise the step of generating signals denoting the moisture content and/or the temperature of fibrous material and utilizing such signals to influence the first signals. Signals denoting the temperature and/or the moisture content of fibrous material can be used to influence the first signals in addition to or in lieu of signals which denote the hardness and/or filling power of the filler.

The method preferably further comprises the step of monitoring the permeability of perforated wrappers, generating additional signals denoting the monitored permeability, comparing the additional signals with the first signals and generating third signals denoting the differences between the first and additional signals, and using the third signals to regulate the perforating step.

Another feature of the invention resides in the provision of an apparatus for making cigarettes or analogous rod-shaped articles of the tobacco processing industry. The apparatus comprises means (such as a distributor unit, a rod treating unit and a filter tipping unit or two of these units) for forming a rod-like filler containing fibrous material (such as fragments of tobacco leaves) and having a predetermined hardness, means for draping the filler into wrapping material (such as tipping paper and/or cigarette paper), means (e.g., a function generator) for generating first signals denoting the mass per unit length of the filler, adjustable (e.g., laser-employing and/or spark generating) means for perforating the wrapping material, and means (e.g., a regulating device for the laser-operated perforating means) for adjusting the perforating means as a function of the first signals.

The apparatus can further comprise means for equalizing the filler, means for generating second signals denoting the hardness of the equalized filler, and means (e.g., a signal comparing stage) for adjusting the equalizing means as a function of second signals. Such apparatus can further comprise means (e.g., an additional signal comparing stage or one of several function generators) for influencing the adjusting means for the perforating means as a function of the second signals.

The apparatus can comprise adjustable means for regulating the mass per unit length of the filler (such adjustable regulating means can constitute or include the aforementioned equalizing means), means for generating second signals denoting the filling power of the fibrous material, and means (e.g., a pair of signal comparing stages or a signal comparing stage in conjunction with one of several function generators) for adjusting the regulating means as a function of the intensity and/or another characteristic of the second signals. For example, the means for adjusting the regulating means can comprise a first signal transmitting function generator, and the means for generating the first signals can comprise a second signal transmitting function generator which modifies the signals from the first function generator and transmits the modified signals to the means for adjusting the perforating means. The forming means can comprise a distributor which is arranged to form a continuous stream of fibrous material, and the means for generating second signals can be disposed in the distributor. The means for generating the second signals can include means for monitoring the filling power of the undraped filler.

The means for forming the filler can comprise means for providing the filler with a surplus of fibrous material which is removed with the aforementioned equalizing means to thus influence the mass per unit length of the equalized filler. The equalizing means can be adjusted as a function of variations of density of the equalized filler.

The apparatus preferably further comprise means for generating additional signals denoting the permeability of perforated wrappers, and the means for adjusting the perforating means then preferably comprises means for comparing the additional signals with the first signals and for generating third signals when the additional signals deviate from the first signals. The third signals are used to adjust the perforating means by way of the respective adjusting means.

The apparatus can comprise a source of wrapping material in the form of tipping paper and/or a source of wrapping material in the form of cigarette paper or the like.

The apparatus can further comprise means for influencing the first signals as a function of fluctuations of the moisture content and/or temperature of fibrous material and/or the hardness and/or the filling power of the filler. In addition to or in lieu of such influencing, the first signals can be influenced by signals denoting the blend of fibrous material which is used to form the filler.

The novel features which are considered as characteristic of the invention are set forth in particular in the appended claims. The improved machine and apparatus themselves, however, both as to their construction and their mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 3:
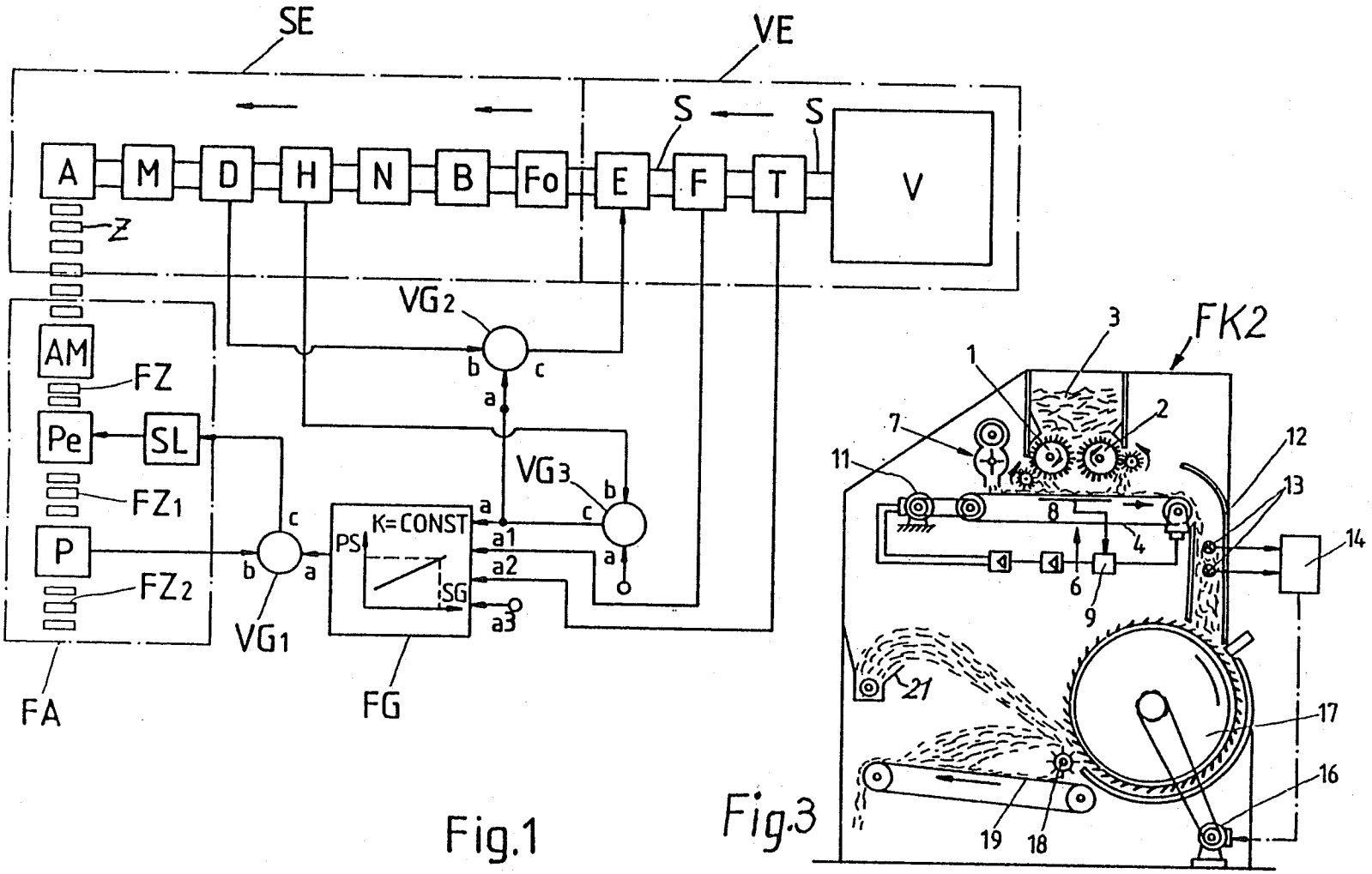
FIG. 1 is a diagrammatic view of a filter cigarette making machine which embodies one form of the improved apparatus.
FIG. 3 is a schematic elevational view of a device for monitoring the filling power of fibrous material in the distributor of a cigarette maker.

FIG. 1 shows a filter cigarette making machine which comprises a distributor unit VE (e.g., of the type disclosed in U.S. Pat. No. 4,185,644 to Heitmann and used in the aforementioned PROTOS machine), a rod treating unit SE (e.g., of the type disclosed in U.S. Pat. No. 4,280,516 to Reuland and used in the PROTOS machine), and a filter tipping unit FA (e.g., of the type disclosed in U.S. Pat. No. 4,281,670 to Heitmann and used in the PROTOS machine).

The distributor unit VE comprises a so-called distributor V (also called hopper) which serves to form a thin layer of tobacco particles and to convert such thin layer into a narrow stream S. The unit VE further comprises a temperature monitoring or measuring device T which generates signals denoting the temperature of successive increments of the stream S. The device T can comprise a conventional semiconductor which is installed in a channel for the tobacco stream and is influenced by changes in the temperature of successive increments of the stream S which is conveyed in a direction to the left. The temperature measuring device T is followed by a moisture measuring or monitoring device F which generates signals denoting the moisture content of successive increments of the stream S. A suitable moisture measuring device is disclosed in commonly owned U.S. Pat. No. 3,979,581 to Reuland. The device F is followed by an adjustable stream trimming or equalizing device E which removes the surplus from and thus converts the stream S into a rod-like filler which enters the rod treating unit SE. A suitable trimming or equalizing device is used in the PROTOS machine. The device E converts the stream S into a rod-like filler which has a predetermined cross-sectional outline as a result of removal of the surplus of tobacco extending from one or more sides of the stream to thus smoothen the external surface of the trimmed stream. An electric motor or other suitable means can be used to move the trimming device E relative to the stream S so as to change the plane of removal of the surplus and hence the quantity of fibrous material per unit length of the filler. Reference may be had to numerous U.S. patents of the assignee of the present application. Thus, the device E can influence the mass flow of fibrous material into the rod treating unit SE.

The rod treating unit SE comprises a conventional wrapping device Fo which drapes the filler into a continuous web of wrapping material (such as a strip of cigarette paper which is drawn from a reel or another suitable source). The wrapping device Fo is followed by a conventional paster B which applies a film of adhesive to one longitudinally extending marginal portion of the running web of wrapping material before such marginal portion is folded over the other marginal portion to complete the conversion of the web into a tubular body surrounding the equalized filler and to form with the other marginal portion of the web a seam extending in parallelism with the axis of the thus obtained cigarette rod. The seam is thereupon heated or cooled by a sealer N (e.g., a conventional tandem sealer) to promote rapid setting of the adhesive.

The cigarette rod is monitored by a hardness measuring device H, e.g., a device of the type disclosed in U.S. Pat. No. 3,921,644 to von der Lohe, in British Pat. No. 1,422,992 or in German Offenlegungsschrift No. 22 41 774. The device H generates signals denoting the hardness of successive increments of the filler in the cigarette rod.

The device H is followed by a measuring or monitoring device D which generates signals denoting the mass flow (quantity or mass per unit length) of the filler in the cigarette rod. A suitable mass flow or density measuring device is manufactured by the assignee of the present application and is known as NSR. This device employs a source of corpuscular radiation (e.g., a source of beta rays) and an ionization chamber which serves as a transducer and transmits signals denoting the mass per unit length of the filler in the cigarette rod.

The device D is followed by a cutoff M which subdivides the cigarette rod into a file of discrete plain cigarettes Z of unit length or multiple (e.g., double) unit length, and such cigarettes are caused to move sideways by a transfer device A of the type used in the aforediscussed PROTOS cigarette maker. The thus diverted cigarettes Z enter the filter tipping unit FA.

The unit FA comprises an applicator AM (used in the aforediscussed MAX 80 assembly of the PROTOS machine) which attaches to each cigarette Z one or more filter mouthpieces by using uniting bands made of so-called tipping paper which is drawn off a bobbin or from another suitable source and is draped around the abutting ends of filter mouthpieces and the respective cigarettes Z. Reference may be had to U.S. Pat. No. 4,281,670 to Heitmann. The thus obtained filter cigarettes FZ are introduced into an adjustable perforating apparatus Pe wherein their wrappers are provided with perforations to alter their permeability and hence the rate of admission of atmospheric air into tobacco smoke. As a rule, the apparatus Pe applies one or more annuli of perforations in the region where the filter mouthpiece of the filter cigarette FZ abuts the respective tobacco-containing portion (either a cigarette Z or a portion of a cigarette Z). The perforating apparatus Pe can employ one or more lasers as disclosed in U.S. Pat. No. 4,281,670 to Heitmann or a spark generating device of the type disclosed in U.S. Pat. No. 4,247,754 to Baier. If the device of Baier is used, the outer layers of the filter mouthpieces are preferably permeable to air.

The reference character SL denotes an apparatus which is used to adjust or regulate the operation of the perforating apparatus Pe in accordance with a feature of the present invention.

Filter cigarettes FZ1 which issue from the perforating apparatus Pe are introduced into a permeability measuring or monitoring device P which generates and transmits signals denoting the actual permeability of the wrappers of rod-shaped articles FZ1. A suitable monitoring device is disclosed in U.S. Pat. No. 4,177,670 to Heitmann. Tested filter cigarettes FZ2 are transported to storage, to a further processing station or to a packing machine. Defective filter cigarettes FZ2 are segregated from satisfactory filter cigarettes and are delivered to a device (not shown) which recovers the particles of tobacco and returns them to the magazine of the distributor V.

The machine of FIG. 1 further comprises a signal comparing stage VG1 whose input a receives a reference signal denoting the desired permeability of the wrappers of articles FZ1, whose input b receives signals from the output of the measuring device P, and whose output c transmits difference signals to the adjusting apparatus SL to regulate the making of perforations in dependency on a plurality of parameters including the mass per unit length of the filler of the cigarette rod.

A second signal comparing stage VG2 has an input a which receives a reference signal denoting the desired mass flow (mass per unit length of the filler), a second input b receiving from the device D signals which denote the actual mass flow of the filler, and an output c which transmits signals to the aforementioned electric motor or other suitable means for adjusting the device E and for thus changing the mass flow.

A third signal comparing stage VG3 has an input a receiving a reference signal denoting the desired hardness of the filler, an input b receiving signals from the device H and denoting the actual hardness of the filler, and an output c which transmits difference signals to the input a of a function generator FG. The signal at the output c of the stage VG3 is further transmitted to the input a of the stage VG2. The signals PG at the output of the function generator FG are transmitted to the input a of the stage VG1 which, in turn, transmits signals to the adjusting apparatus SL. The signals PS are stored in the function generator FG and are modified in accordance with changes in characteristics of the input signals SG. It is assumed that the condensate K in the smoke which develops during smoking of tested filter cigarettes FZ2 is at least substantially constant i.e., that the taste of the smoke changes little or not at all.

The input a1 of the function generator FG receives signals from the moisture measuring device F, and the input a2 of the function generator receives signals from the temperature measuring device T. Such signals influence the output signals PS. The input a3 of the function generator FG can receive signals from a device (not shown) which monitors the blend (mixture) of the material forming the stream S.

Regulation of output signals PS in dependency on signals from the devices F and T is desirable and advantageous because the hardness of the filler depends on the temperature and moisture content of fibrous material forming the stream S.

The mode of operation is as follows:

The distributor V forms a homogeneous shower of tobacco particles, and such shower is converted into the narrow stream S. The devices T and F respectively generate signals which denote the temperature and the moisture content of successive increments of the stream S, and such signals are transmitted to the corresponding inputs a1 and a2 of the function generator FG. The stream S is equalized by the device E, and the resulting filler is draped into cigarette paper in the wrapping device Fo to form with the wrapping material a continuous cigarette rod. The wrapping material is coated with adhesive by the paster B, and the seam is conditioned by the sealer N upstream of the hardness measuring device H. The device H transmits to the input b of the signal comparing stage VG3 signals which denote the hardness of successive increments of the filler in the cigarette rod, and successive increments of the filler in the rod are then monitored by the device D which transmits signals to the input b of the signal comparing stage SG2, such signals denoting the mass per unit length of the filler in the cigarette rod. The cutoff M subdivides the rod into discrete cigarettes Z which are deflected by the device A to enter the tipping device AM which turns out filter cigarettes FZ. The filter cigarettes FZ are treated in the perforating apparatus Pe which provides the wrappers of the plain cigarettes, the wrappers of the uniting bands and/or the wrappers of the filter mouthpieces with one or more rows or other arrays of perforations to thus increase the permeability of the wrappers. The operation of the apparatus Pe is regulated by the adjusting apparatus SL in accordance with the signals at the output c of the signal comparing stage SG1. Filter cigarettes FZ1 which leave the apparatus Pe are monitored in the device P which transmits signals denoting the permeabilities of the wrappers to the input b of the stage SG1. Such signals are compared with signals PS at the input a of the stage SG1, and the signals at the output c of the stage SG1 are indicative of differences between the characteristics of signals PS and signals from the device P to adjust the apparatus Pe accordingly by way of the apparatus SL. The device P ensures that the permeability of each filter cigarette FZ2 matches or sufficiently approximates that which is denoted by reference signals PS transmitted by the output of the function generator FG.

If the device H transmits a signal whose intensity and/or another characteristic deviates from the corresponding characteristic of the selected reference signal at the input a of the stage VG3, the output c of the stage VG3 transmits a signal SG to the input a of the function generator FG. At the same time, the signal which is generated by the stage VG3 is transmitted to the input a of the stage VG2 whose output c then transmits a signal to adjust the level of the trimming device E, i.e., to change the mass flow of fibrous material in the path leading to the device D. The signals which are generated by the device D are compared with those at the input a of the stage VG2 to ensure that the adjustment of the level of the trimming device E is completed as soon as the mass flow reaches a value which is denoted by the characteristics of the signal at the input a of the stage VG2.

The signal which is transmitted to the input a of the function generator FG influences the function generator to transmit a modified output signal PS which is transmitted to the adjusting apparatus SL by way of the stage VG1 to influence the perforating action at Pe. The intensity and/or another characteristic of the output signal PS can also be influenced by signals which are applied to the inputs a1, a2, a3 of the function generator FG, i.e., by changes in the moisture content, temperature and/or mixture of fibrous material. Such signals influence the characteristics of the input signal SG.

Figure 2:
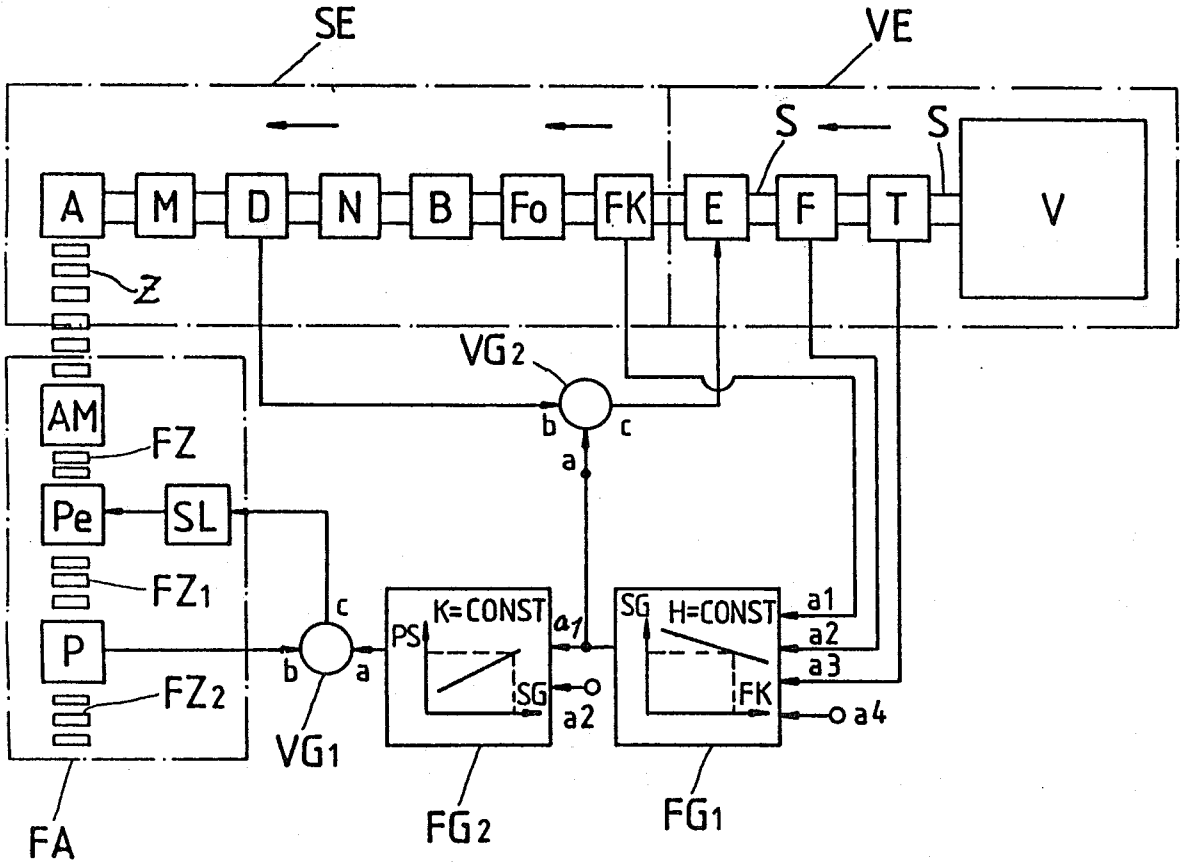
FIG. 2 is a similar diagrammatic view of a filter cigarette making machine which embodies a modified apparatus.

FIG. 2 shows a modified filter cigarette making machine wherein all such units, stages, devices and apparatus which are identical with or clearly analogous to the corresponding components of the machine of FIG. 1 are denoted by similar reference characters.

The device H of FIG. 1 (which directly ascertains the hardness of the filler of the cigarette rod) is replaced with a device FK which is designed to indirectly monitor the hardness of the filler (e.g., in a manner as disclosed in U.S. Pat. No. 4,280,516, in U.S. Pat. No. 4,290,436 or in U.S. Pat. No. 4,284,087) and to transmit appropriate signals to the input a1 of a first function generator FG1 which replaces the signal comparing stage VG3 of FIG. 1. The function generator FG1 transmits output signals SG which are applied to the input a of the signal comparing stage SG2 as well as to the input a1 of a second function generator FG2. Signals SG at the output of the function generator FG1 denote the desired mass flow of fibrous material. The operation of the function generator FG1 is based on the assumption that the hardness H of the filler is at least substantially constant. The inputs a2 and a3 of the function generator FG1 receive signals from the moisture measuring device F and from the temperature monitoring device T, respectively. The input a4 of the function generator FG1 receives a signal denoting the mixture or blend of fibrous material forming the stream S.

The signal SG at the output of the function generator FG1 is compared with the signal at the input b of the stage VG2, and the latter transmits a signal which is used to adjust the level of the equalizing device E until the signal from the mass flow measuring device D matches the signal from the output of the function generator FG1. The signals PS at the output of the second function generator FG2 are transmitted to the input a of the stage VG1 whose mode of operation is analogous to that of the similarly referenced stage in the machine of FIG. 1. The operation of the second function generator FG2 is based on the assumption that the quantity of condensate K in the smoke is substantially constant. The input a2 of the function generator FG2 receives a signal which is indicative of a characteristic of fibrous material, e.g., of the mixture of tobacco particles which form the stream.

FIG. 3 shows certain detail of a distributor or hopper which can be used in the machine of FIG. 2 and contains a filling power or firmness measuring device FK2 which can be used in lieu of the device FK. Two carded drums 1 and 2 are provided to draw tobacco particles from a magazine 3, and two picker rollers (not referenced) are used to expel fibrous material from the carding of the drums 1, 2 and to propel the expelled particles onto the upper reach of the endless belt 4 of a belt weigher or scale 6. A transducer 8 generates signals which denote the quantity of fibrous material on the upper reach of the belt 4 of the weigher 6, and such signals are transmitted to a regulator 9 for a motor 11 which drives the belt 4 at a variable speed. A feeder 7 supplies the removed surplus from the equalizing device E. The arrangement is such that the right-hand end of the belt 4 delivers fibrous material at a constant rate into an upright duct 12 wherein the upper level of the accumulated column of fibrous material is monitored by one or more photoelectric cells 13 or other suitable monitoring means in a manner which is described in U.S. Pat. No. 4,185,644 to Heitmann. Signals which are generated by the monitoring means 13 are transmitted to an evaluating circuit 14 which controls the operation of a variable-speed motor 16 for a carded drum 17 serving to draw fibrous material from the outlet at the lower end of the duct 12. Fibrous material which is entrained by the carding of the drum 17 is expelled by a picker roller 18 which propels the material onto a belt conveyor 19 corresponding to the conveyor 41 in FIG. 1 of U.S. Pat. No. 4,185,644 to Heitmann. Heavier particles of fibrous material (such as fragments of tobacco ribs) are intercepted by a trough 21, and the lighter particles advance into the stream forming zone to be used for the formation of the stream S.

If the filling power of fibrous material in the duct 12 remains unchanged, the drum 17 withdraws fibrous material at the rate at which the upper end of the duct 12 receives fibrous material from the belt 4 of the weigher 6. When the filling power of fibrous material changes, the drum 17 withdraws more fibrous material per unit of time than before (while its RPM remains unchanged) if the filling power of fibrous material decreases, and the drum 17 withdraws less fibrous material per unit of time (while its RPM remains unchanged) if the filling power of the fibrous material increases. The level of the column of fibrous material in the duct 12 then changes, and such change is detected by the monitoring means 13 which induces the evaluating circuit 14 to alter the RPM of the drum 17 so that the rate of withdrawal is again constant and the drum 17 again draws a stream wherein the mass flow is constant. Thus, the signal at the output of the evaluating circuit 14 is indicative of the filling power of fibrous material in the distributor V and can be transmitted to the input a1 of the first function generator FG1 of FIG. 2 in lieu of the signal from the filling power measuring device FK. It is further possible to connect the output of the evaluating circuit 14 with the regulator 9 for the motor 11 so that the speed of the belt 4 of the weigher 6 can be caused to conform to the changed filling power of fibrous material.

The perforating apparatus Pe can be designed to provide certain first portions of the wrappers with holes by means of one or more lasers and certain second portions of the wrappers with holes which are formed with spark discharge as disclosed in the patent to Baier.

The signals which are applied to the input a3 of the function generator FG of FIG. 1 or to the input a4 of the function generator FG1 of FIG. 2 can be determined empirically.

An important advantage of the improved apparatus and of the machine which embodies such apparatus is that the regulation of permeability of the wrappers does not affect the taste of the smoke and/or the quantity of condensate in the smokers' products so that it is possible to accurately report the quantities of condensate on the packs for cigarettes and the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of regulating the permeability of wrappers of cigarettes or other rod-shaped articles of the tobacco processing industry, comprising the steps of forming and transporting a continuous rod-like filler containing fibrous material; continously and automatically monitoring the filling power of fibrous material which is used to form the filler or the hardness of the filler and generating first signals denoting the monitored filling power or hardness; draping the filler into wrapping material; regulating the mass of fibrous material in the filler as a function of said first signals so as to maintain the hardness of the filler at a predetermined value; monitoring the mass of fibrous material in the filler and generating second signals denoting the mass per unit length of the filler; perforating the wrapping material; and utilizing said second signals to adjust said perforating step.

2. The method of claim 1, wherein said adjusting step includes utilizing said first signals to adjust said perforating step.

3. The method of claim 1, further comprising the step of utilizing said first signals to equalize the filler prior to said draping step.

4. The method of claim 1, further comprising the step of utilizing said first signals to equalize the filler prior to said draping step.

5. The method of claim 1, wherein said perforating step includes changing the permeability of the wrapping material subsequent to said draping step.

6. The method of claim 1, further comprising the steps of subdividing the draped filler into rod-like sections of predetermined length and tipping said sections including providing the sections with filter mouthpieces, said perforating step including changing the permeability of the wrapping material of tipped rod-like sections.

7. The method of claim 1, wherein said forming step comprises assembling rod-like sections of smokable fibrous material with rod-like filter mouthpieces and the wrapping material includes tipping paper, said draping step including applying tipping paper around the sections and the respective filter mouthpieces.

8. The method of claim 7, wherein each filter mouthpiece has a foraminous outer layer and said perforating step includes increasing the permeability of tipping paper prior to said draping step.

9. The method of claim 1, wherein said perforating step includes subjecting the wrapping material to the action of a laser beam.

10. The method of claim 1, wherein said perforating step includes effecting a spark discharge between opposite sides of the wrapping material.

11. The method of claim, 1, further comprising the steps of generating additional signals denoting the moisture content of fibrous material and utilizing said additional signals to influence said signals.

12. The method of claim 1, further comprising the steps of generating third signals denoting the moisture content of fibrous material, and using said third signals to influence said second signals.

13. The method of claim 1, further comprising the steps of generating additional signals denoting the temperature of fibrous material and utilizing the additional signals to influence said second signals.

14. The method of claim 1, further comprising the steps of, generating third signals denoting the temperature of fibrous material, and using said third signals to influence said signals.

15. The method of claim 1, further comprising the steps of subdividing the draped filler into rod-shaped sections having tubular wrappers, generating third signals denoting the permeability of the wrappers of such sections, comparing said third signals with said second signals and generating fourth signals denoting the differences between said compared second and third signals, and utilizing said fourth signals to adjust said perforating step.

16. Apparatus for making cigarettes or analogous rod-shaped articles of the tobacco processing industry, comprising means for forming and transporting a rod-like filler containing fibrous material; means for draping the filler into wrapping material; means for continuously and automatically monitoring the filling power of fibrous material which is used to form the filler or the hardness of the filler and for generating first signals denoting the monitored filling power or hardness; means for regulating the mass of fibrous material in the filler as a function of said first signals so as to maintain the hardness of the filler at a predetermined value; means for monitoring the mass of fibrous material in the filler and for generating second signals denoting the mass per unit length of the filler; adjustable means for perforating the wrapping material; and means for adjusting said perforating means as a function of said second signals.

17. The apparatus of claim 16, further comprising adjustable means for equalizing the filler and means for adjusting said equalizing means as a function of said first signals.

18. The apparatus of claim 17, further comprising means for influencing said adjusting means for said perforating means as a function of said first signals.

19. The apparatus of claim 16, wherein said regulating means is adjustable and further comprising means for adjusting said regulating means as a function of said first signals.

20. The apparatus of claim 19, wherein said adjusting means for said regulating means comprises a first signal transmitting function generator, said means for generating said second signals comprising a second function generator arranged to modify the signals which are transmitted by said first function generator and to transmit the thus modified signals to said adjusting means for said perforating means.

21. The apparatus of claim 19, wherein said forming means comprises a distributor arranged to form a continuous stream of fibrous material, said means for generating said first signals being disposed in said distributor.

22. The apparatus of claim 19, wherein said means for generating said first signals includes means for monitoring the filling power of the undraped filler.

23. The apparatus of claim 16, wherein said means for forming the filler comprises means for providing the filler with a surplus of fibrous material and further comprising adjustable equalizing means for removing said surplus from the filler and for thus influencing the mass per unit length of the equalized filler, and means for adjusting said equalizing means as a function of variations of density of the equalized filler.

24. The apparatus of claim 16, further comprising means for generating third signals denoting the permeability of perforated wrapping material, said adjusting means including means for comparing said third signals with said second signals and for generating fourth signals which denote the difference between said compared second and third signals and are used to adjust said perforating means.

25. The apparatus of claim 16, wherein said means for perforating the wrapping material comprises at least one laser.

26. The apparatus of claim 16, wherein said perforating means includes means for effecting a spark discharge between opposite sides of the wrapping material.

27. The apparatus of claim 16, further comprising a source of wrapping material in the form of cigarette paper.

28. The apparatus of claim 16, further comprising a source of wrapping material in the form of tipping paper.

29. The apparatus of claim 16, further comprising means for influencing said second signals as a function of fluctuations of the temperature of fibrous material.

30. The apparatus of claim 16, further comprising means for influencing said first signals as a function of fluctuations of the moisture content of fibrous material.

31. The apparatus of claim 16, further comprising means for influencing said second signals as a function of fluctuations in the moisture content and/or temperature of fibrous material.

32. The apparatus of claim 16, wherein the fibrous material is a mixture of a plurality of different fibrous materials and further comprising means for influencing said second signals as a function of deviations of said mixture from a predetermined mixture.

33. A method of regulating the permeability of wrappers of cigarettes or other rod-shaped articles of the tobacco processing industry, comprising the steps of forming a rod-like filler containing fibrous material and having a predetermined hardness; draping the filler into wrapping material; generating first signals denoting the mass per unit length of the filler; perforating the wrapping material; utilizing said first signals to adjust said perforating step; generating second signals denoting the moisture content of fibrous material; and utilizing said second signals to influence said first signals.

34. A method of regulating the permeability of wrappers of cigarettes or other rod-shaped articles of the tobacco processing industry, comprising the steps of forming a rod-like filler containing fibrous material and having a predetermined hardness; draping the filler into wrapping material; generating first signals denoting the mass per unit length of the filler; perforating the wrapping material; utilizing said first signals to adjust said perforating step; generating second signals denoting the hardness of the filler; utilizing said second signals to influence the mass per unit length of the filler; generating third signals denoting the moisture content of fibrous material; and using said third signals to influence said first signals.

35. A method of regulating the permeability of wrappers of cigarettes or other rod-shaped articles of the tobacco processing industry, comprising the steps of forming a rod-like filler containing fibrous material and having a predetermined hardness; draping the filler into wrapping material; generating first signals denoting the mass per unit length of the filler; perforating the wrapping mateial; utilizing said first signals to adjust said perforating step; generating second signals denoting the temperature of fibrous material; and utilizing the second signals to influence said first signals.

36. A method of regulating the permeability of wrappers of cigarettes or other rod-shaped articles of the tobacco processing industry, comprising the steps of forming a rod-like filler containing fibrous material and having a predetermined hardness; draping the filler into wrapping material; generating first signals denoting the mass per unit length of the filler; perforating the wrapping material; utilizing said first signals to adjust said perforating step; generating second signals denoting the hardness of the filler; utilizing said second signals to influence the mass per unit length of the filler; generating third signals denoting the temperature of fibrous material; and using said third signals to influence said first signals.

37. A method of regulating the permeability of wrappers of cigarettes or other rod-shaped articles of the tobacco processing industry, comprising the steps of forming a rod-like filler containing fibrous material and having a predetermined hardness; draping the filler into wrapping material; generating first signals denoting the mass per unit length of the filler; perforating the wrapping material; utilizing said first signals to adjust said perforating step; subdividing the draped filler into rod-shaped sections having tubular wrappers; generating second signals denoting the permeability of the wrappers of such sections; comparing said second signals with said first signals and generating third signals denoting the difference between said compared first and second signals; and utilizing said third signals to adjust said perforating step.

38. Apparatus for making cigarettes or analogous rod-shaped articles of the tobacco processing industry, comprising means for forming a rod-like filler containing fibrous material and having a predetermined hardness; means for draping the filler into wrapping material; means for generating signals denoting the mass per unit length of the filler; means for influencing said signals as a function of fluctuations of the temperature of fibrous material; adjustable means for perforating the wrapping material; and means for adjusting said perforating means as a function of said signals.

39. Apparatus for making cigarettes or analogous rod-shaped articles of the tobacco processing industry, comprising means for froming a rod-like filler containing fibrous material and having a predetermined hardness; means for draping the filler into wrapping material; means for generating signals denoting the mass per unit length of the filler; means for influencing said signals as a function of fluctuations of the moisture content of fibrous material; adjustable means for perforating the wrapping material; and means for adjusting said perforating means as a function of said signals.

40. Apparatus for making cigarettes or analogous rod-shaped articles of the tobacco processing industry, comprising means for forming a rod-like filler containing fibrous material and having a predetermined hardness; means for draping the filler into wrapping material; means for generating signals denoting the mass per unit length of the filler; means for influencing said signals as a function of fluctuations in the moisture content and/or temperature of fibrous material and/or the hardness and/or filling power of the filler; adjustable means for perforating the wrapping material; and means for adjusting said perforating means as a function of said signals.

41. Apparatus for making cigarettes or analogous rod-shaped articles of the tobacco processing industry, comprising means for forming a rod-like filler having a predetermined hardness and containing fibrous material which is a mixture of a plurality of different fibrous materials; means for draping the filler into wrapping material; means for generating signals denoting the mass per unit length of the filler; means for influencing said signals as a function of deviations of said mixture from a predetermined mixture; adjustable means for perforating the wrapping material; and means for adjusting said perforating means as a function of said signals.

* * * * *